US006446877B1

(12) United States Patent
Gaines et al.

(10) Patent No.: US 6,446,877 B1
(45) Date of Patent: Sep. 10, 2002

(54) GAS FIRED HUMIDIFIER

(75) Inventors: Michael H. Gaines, Kalamazoo, MI (US); Carl Suchovsky, Aurora, OH (US); Paul K. Holliday, Portage, MI (US)

(73) Assignee: Armstrong International, Incorporated, Stuart, FL (US)

( * ) Notice: Subject to any disclaimer, the term of this patent is extended or adjusted under 35 U.S.C. 154(b) by 0 days.

(21) Appl. No.: 09/708,862

(22) Filed: Nov. 8, 2000

(51) Int. Cl.[7] ..... F24F 3/14

(52) U.S. Cl. ..... 237/78 R; 237/78 A; 165/222

(58) Field of Search ..... 237/78 R, 78 A; 454/337, 328, 291; 261/129; 236/44; 165/222, 223

(56) References Cited

U.S. PATENT DOCUMENTS

| | | | | |
|---|---|---|---|---|
| 2,148,720 A | | 2/1939 | Armstrong | |
| 2,169,683 A | | 8/1939 | Dunham et al. | |
| 2,328,538 A | | 9/1943 | Furlong | |
| 2,358,968 A | | 9/1944 | Furlong et al. | |
| 2,443,359 A | * | 6/1948 | Newhouse | 237/78 R |
| 3,305,173 A | | 2/1967 | Beckman | |
| 3,444,921 A | | 5/1969 | Carapico, Jr. | |
| 3,815,254 A | | 6/1974 | Mills | |
| 3,824,985 A | | 7/1974 | Hetherington | |
| 3,840,025 A | | 10/1974 | Fowler et al. | |
| 4,146,775 A | | 3/1979 | Kirchner et al. | |
| 4,466,422 A | * | 8/1984 | Lahiri | 126/313 |
| 4,474,117 A | | 10/1984 | Marollaud | |
| 4,582,123 A | * | 4/1986 | Williams | 165/21 |
| 4,672,919 A | | 6/1987 | Staats | |
| 4,697,735 A | | 10/1987 | Temple | |
| 4,906,178 A | | 3/1990 | Goldstein et al. | |
| 4,932,218 A | * | 6/1990 | Robbins | 62/171 |
| 5,184,600 A | | 2/1993 | Astle, Jr. | |
| 5,199,486 A | * | 4/1993 | Balmer et al. | 165/47 |
| 5,215,043 A | | 6/1993 | Tsutsumi | |
| 5,355,841 A | | 10/1994 | Moore, Jr. et al. | |
| 5,422,976 A | | 6/1995 | Knepler | |
| 5,544,625 A | | 8/1996 | Rivern | |
| 5,718,060 A | | 2/1998 | Mori | |
| 5,740,790 A | | 4/1998 | Lipsky | |
| 5,816,496 A | | 10/1998 | Kovacs | |
| 6,129,285 A | * | 10/2000 | Schafka | 236/44 C |

FOREIGN PATENT DOCUMENTS

| | | |
|---|---|---|
| GB | 1223836 | 3/1971 |

* cited by examiner

*Primary Examiner*—Harold Joyce
*Assistant Examiner*—Derek S. Boles
(74) *Attorney, Agent, or Firm*—MacMillan, Sobanski & Todd, LLC

(57) ABSTRACT

A system for providing humidified air includes a tank containing water and one or more heat exchanger tubes mounted in the tank. The system includes a burner assembly positioned to supply heat to the heat exchanger tubes. The system includes an induction fan for inducing combustion gases from the burner assembly through the heat exchanger tubes. Heat from the burner assembly in the heat exchanger tubes generates steam in the tank. The system includes a steam dispersion apparatus connected to the tank for humidifying air with the steam and a means for measuring humidity in a target location. The system also includes a controller for controlling one or both of the fuel supply to the burner assembly or the induction fan in response to the measured humidity in the target location.

28 Claims, 4 Drawing Sheets

GAS FIRED HUMIDIFIER

TECHNICAL FIELD

This invention relates to a system of humidifying air. More specifically, this invention relates to a system of humidifying air with a gas fired humidifier.

BACKGROUND OF THE INVENTION

The need for a controlled supply of humidified air in medical and other applications is well documented. For example, a controlled supply of humidified air is needed to maintain a clean room in a hospital. Temperature, air pressure, and humidity conditions must be maintained precisely to maintain a pristine clean room. Problems associated with excessively dry air are well documented. The need to provide and maintain clean rooms is well known in the medical profession. Similarly, the importance of clean rooms is known to be critical in semiconductor chip fabrication operations as well as in the manufacture of other products.

Relatively small electric humidifiers are sometimes used in various building locations to provide the required humidity for clean rooms, etc. . . . Electric humidifiers generally employ an electric heating element for producing steam from a body of water. The steam is added to the building air supply to add water vapor to the air, thereby raising the humidity. It is also known to use relatively small gas fired humidifiers to provide humidity to selected areas of a building. One example of a known gas fired humidifier is described in U.S. Pat. No. 5,816,496 to Kovacs (hereinafter Kovacs). Kovacs discloses a stand-alone gas fired humidifier. These relatively small steam generating units are advantageous in not requiring long steam piping runs from a central source of building steam.

Typically, building humidification systems are centrally located large scale units which generate large quantities of steam to humidify various portions of the building. These large scale units are typically positioned at locations which are remote from the areas of the building to be humidified. Air ducts and other pipes are required to carry the steam or water vapor from the remote locations to the area to be humidified. Humidity detectors are generally used with humidifiers to modulate the amount of steam being produced.

When large scale humidification systems are employed, they lack the delicate controls that can be required to maintain the proper humidity in a relatively small area, such as a clean room. It would thus be desirable to provide a more efficient and more precisely controlled system for humidifying air with a gas fired humidifier.

SUMMARY OF THE INVENTION

The above objects as well as other objects not specifically enumerated are achieved by a system for providing humidified air. The system includes a tank containing water and one or more heat exchanger tubes mounted in the tank. The system includes a burner assembly positioned to supply heat to the heat exchanger tubes. The system includes an induction fan for inducing combustion gases from the burner assembly through the heat exchanger tubes. Heat from the burner assembly in he heat exchanger tubes generates steam in the tank. The system includes a steam dispersion apparatus connected to the tank for humidifying air with the steam and a means for measuring humidity in a target location. The system also includes a controller for controlling one or both of the fuel supply to the burner assembly or the induction fan in response to the measured humidity in the target location. According to this invention there is also provided a system for providing humidified air in a building. The system includes a tank containing water and one or re heat exchanger tubes mounted in the tank. The system includes a burner assembly positioned to supply heat to the heat exchanger tubes. The system includes an induction fan for inducing combustion gases from the burner assembly through the heat exchanger tubes. Heat from the burner assembly in the heat exchanger tubes generates steam in the tank. The system includes a steam dispersion apparatus connected to the tank for humidifying building air with the steam and a means for measuring humidity in a target location in the building. The system also includes a controller for controlling one or both of the fuel supply to the burner assembly or the induction fan in response to the measured humidity in the target location.

According to this invention there is also provided a method for controlling an air humidification process in a building. The method includes measuring the amount of humidity in a target location. The method includes providing fuel to one or more burner assemblies wherein the fuel is provided at a rate that varies within a range, and burning the fuel to generate combustion gases. The method also includes drawing the combustion gases with an induction fan from the one or more burner assemblies through a plurality of heat exchanger tubes to generate steam. The heat exchanger tubes are mounted in a tank containing water. The method also includes humidifying building air with the steam using a steam dispersion apparatus and controlling one or both of the fuel supply to the burner and the induction fan in response to the measured humidity in the target location.

According to this invention there is also provided a method for controlling an air humidification process. The method includes measuring the amount of humidity in a target location. The method includes providing fuel to one or more burner assemblies wherein the fuel is provided at a rate that varies within a range, and burning the fuel to generate combustion gases. The method also includes drawing the combustion gases with an induction fan from the one or more burner assemblies through a plurality of heat exchanger tubes to generate steam. The heat exchanger tubes are mounted in a tank containing water. The method also includes humidifying air with the steam using a steam dispersion apparatus and controlling one or both of the fuel supply to the burner and the induction fan in response to the measured humidity in the target location.

Various objects and advantages of this invention will become apparent to those skilled in the art from the following detailed description of the preferred embodiment, when read in light of the accompanying drawings.

DETAILED DESCRIPTION OF THE INVENTION

Figure 2:
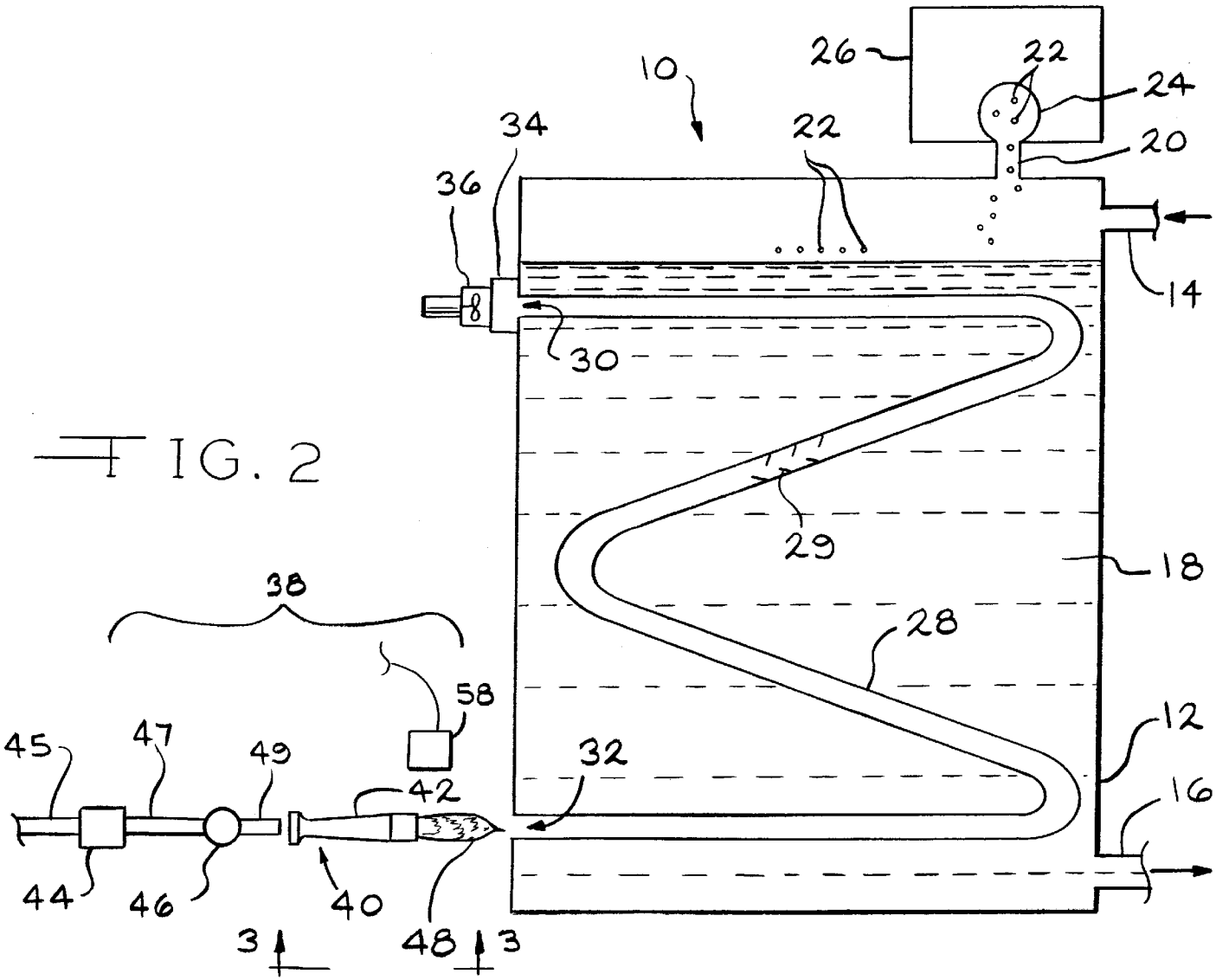
FIG. 2 is a cross-sectional elevational view of the gas fired humidifier according to the invention shown in FIG. 1.

The description and drawings disclose a system for providing steam from a gas fired humidifier to a desired location, such as a clean room. As shown in FIG. 2, a gas fired humidifier 10 includes a tank 12. The tank 12 is preferably made of stainless steel, though any suitable heat-resistant and water-resistant material could be employed. A water supply pipe 14 and drain pipe 16 are provided to the tank 12 to fill the tank 12 with water 18 and release water 18 from the tank 12 respectively. The tank 12 is preferably a hollow six-sided geometric shape. The tank 12 may also be a hollow cylindrical shape or any other suitable shape. In a preferred embodiment, the tank 12 includes opposing sides that are generally parallel to each other and adjacent sides that are at approximately right angles to each other.

A steam outlet 20 is also provided, preferably at the top of the tank 12. It should be understood that the steam outlet 20 may be located at any suitable location on the tank 12. The tank 12 preferably includes a suitable lid (not shown) at the top of the tank 12. When the water 18 in the tank 12 is heated to an appropriate temperature, by a structure to be described below, the water 18 turns to steam 22 which rises to the top of the tank 12. The steam 22 passes through the steam outlet 20, either directly or indirectly, into a steam dispersion apparatus, such as a steam distributor 24. The steam distributor 24 segregates the steam 22 from any condensate associated with the steam 22 and distributes the steam 22 in an air duct 26. The air traveling through the duct 26 is thereby made more humid. The steam distributor 24 is preferably housed in the duct 26.

In a preferred embodiment, the duct 26 transports the steam 22, and thereby provides steam, to a desired location. The desired location includes a target location 64 (shown in FIG. 1). The desired location can include such locations as a hospital clean room, a hospital operating room, a clean room in an electronics production plant or some other appropriate location in a building. The desired location may also be a non-building based location, such as a station associated with a manufacturing process wherein the steam 22 is not delivered in the duct 26. For example, a paper manufacturing process which requires a steam or humidity application may be considered a desired location. In one embodiment of the invention, the steam distributor 24 is positioned at or directly adjacent to a process location rather than within a duct supplying air to the process location. In a preferred embodiment, the amount of humidity in the target location 64 is measured by an appropriate measurement device such as a humidity 62 (shown in FIG. 1). The humidity 62 communicates with a controller 66 (shown in FIG. 1) to control the level of humidity as will be described below.

Figure 4:
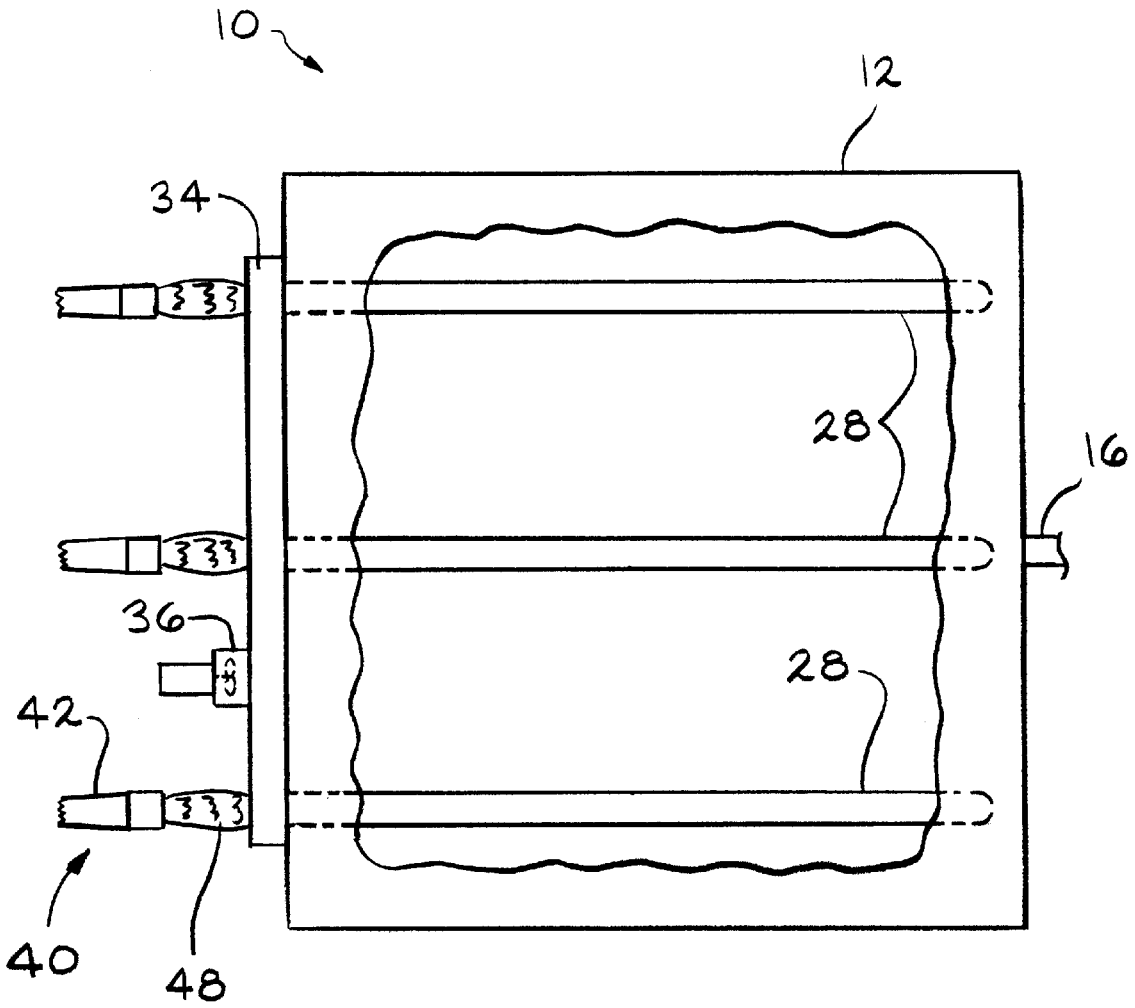
FIG. 4 is a plan view of the gas fired humidifier of FIG. 1, with a portion of the figure cut-away to show the heat exchanger tubes.

A heat exchanger tube 28 is provided within the tank 12. It should be understood that a plurality of heat exchanger tubes 28 can be employed. In a preferred embodiment, a plurality of heat exchanger tubes 28 are mounted in the tank 12 (shown in FIG. 4). The heat exchanger tube 28 is preferably made of stainless steel, though any suitable heat-resistant and water-resistant material could be employed. The heat exchanger tube 28 preferably has a round cross-sectional shape, but can have any suitable cross-sectional shape. Though any diameter heat exchanger tube 28 could be employed, the heat exchanger tube 28 having a diameter within the range of from about 1 & ½ inch to about 2 & ¼ inches is well suited for use with a humidifier having a capacity of about within the range of from about 100 pounds per hour to about 300 pounds per hour. The heat exchanger tube 28 shown in FIG. 2 includes four passes within the tank 12. In this context, a pass is a generally straight section of tube before and/or after a curved section. It should be understood that any suitable number of passes may be employed. The heat exchanger tube 28 shown in FIG. 2 is generally serpentine in shape. In this context, serpentine is taken to mean a winding or turning contour.

One or more baffles 29 or other forms of heat exchange enhancers can be disposed within the interior of the heat exchanger tube 28 to increase the transfer of heat from the combustion gases in the heat exchanger tube 28 to the water 18. The baffles 29 increase heat transfer by creating relatively convoluted flow patterns for the combustion gases in the heat exchanger tube 28. Other ways of enhancing the efficiency of the heat exchanger tubes 28 may be employed, such as an exterior fin (not shown), or a restriction plate. Likewise, the heat exchanger tube 28 may be suitably deformed to improve heat transfer. The heat exchanger tube 28 is bounded at one end by an outlet 30 and at the other end by an inlet 32. In a preferred embodiment, the outlet 30 of the heat exchanger tube 28 is at or near the top of the tank 12, but may also be located at or near the bottom of the tank 12.

In a preferred embodiment, an exit manifold 34 is connected to an induction fan 36 is provided at the outlet 30 of the heat exchanger tube 28. The induction fan 36 is understood to be a fan which draws combustion gases through the heat exchanger tube 28. The induction fan 36 preferably draws flame and combustion gases from the inlet 32 of the heat exchanger tube 28 through the heat exchanger tube 28, out of outlet 30 of the heat exchanger tube 28, and through the exit manifold 34.

In a preferred embodiment, the induction fan 36 is a two-speed fan. The induction fan 36 can be a single-speed fan or a variable-speed fan. During operation of the gas fired humidifier 10, the rate of drawing the combustion gases with the induction fan is controlled in response to the demand for humidity as determined by the measurement of humidity in the target location 64. Though any suitable induction fan 36 could be used, a Fasco two-speed combustion fan, Number 7021-10987, type U21 B is well suited for use with a humidifier having a capacity of within the range of from about 100 pounds per hour to about 300 pounds per hour. It should be understood that any suitable number of induction fans 36 may be employed.

A fuel supply train 38 is provided to supply fuel to the burner assembly 40. The fuel supply train 38 includes those structures or set of structures, such as valves, pipes, manifolds, and the like, that deliver fuel to the burner assembly 40 in a controlled way. The burner assembly 40 may include one or more burners 42 (shown in FIG. 4). The burners 42 provide a flame into the heat exchanger tube 28.

The fuel supply train 38 includes a valve 44 which is supplied with a gaseous fuel by a pipe 45 connected to a fuel supply (not shown). It should be understood that the valve 44 may be a single valve, or may include a plurality of valves. In a preferred embodiment, the valve 44 has a turn-down ratio of about four to one. The valve 44 may also have a turn-down ratio of about 1.5 to 1, or any other suitable turn-down ratio. The term "turn-down ratio" means the highest possible operational fuel supply rate at which fuel is provided through the valve 44 divided by the lowest possible operational fuel supply rate at which fuel is provided through the valve 44. The valve's range of fuel supply rates is from the lowest possible fuel supply rate to the highest possible fuel supply rate. During operation of the gas fired humidifier 10, the rate of providing fuel to the burner assembly 40 is controlled in response to the demand for humidity as determined by the measurement of humidity in the target location 64. Though any suitable valve can be employed, a White-Rodgers Modulating gas valve, model number 36E27201 is well suited for use with a humidifier having a capacity within the range of from about 100 pounds per hour to about 300 pounds per hour. It should be understood that any suitable number of valves 44 may be employed.

Figure 3:
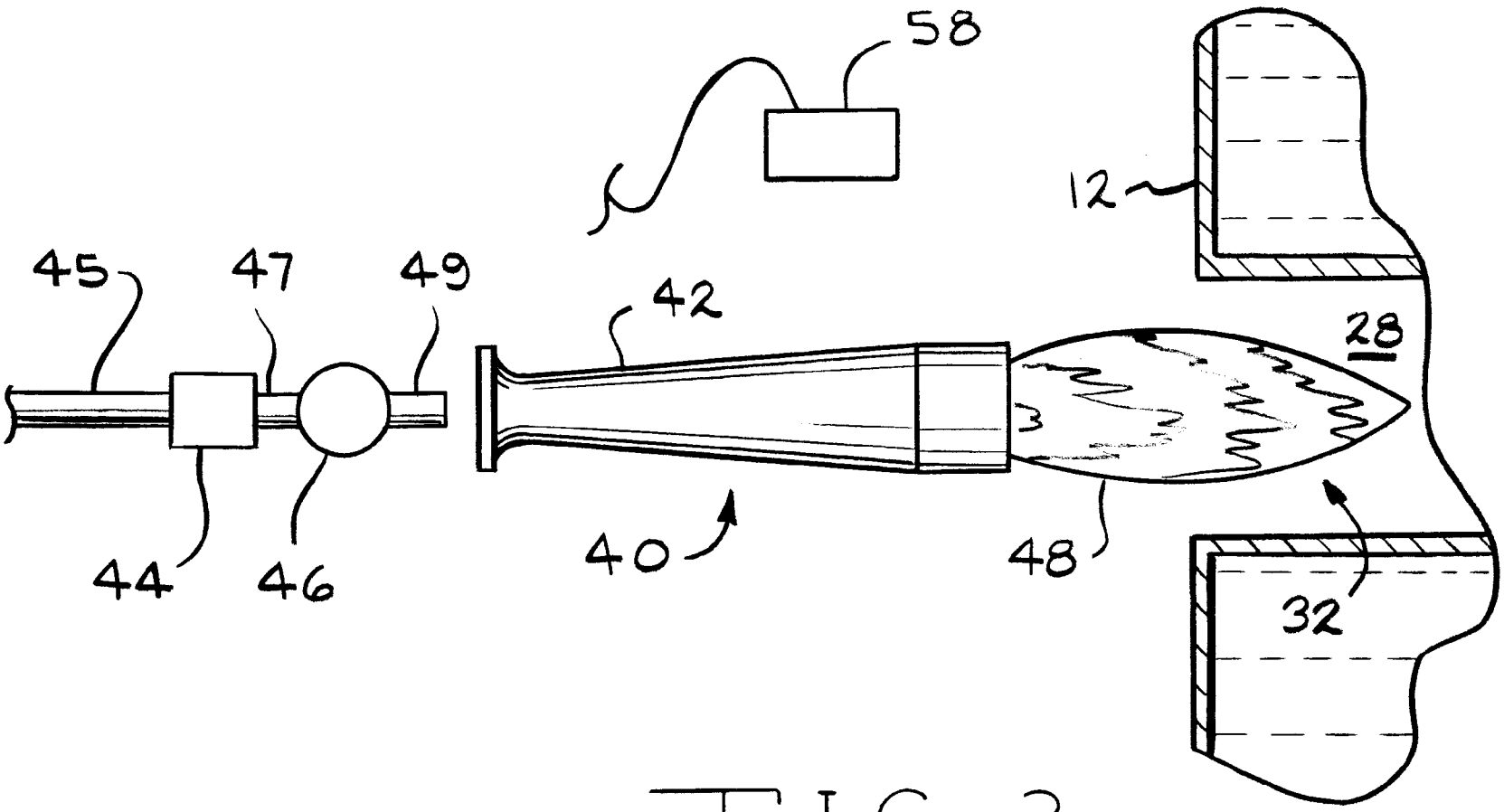
FIG. 3 is an elevational view in cross-section of a portion of the gas fired humidifier of FIGS. 1 and 2, taken along line 3—3 of FIG. 2.

The fuel supply train 38 also includes an supply manifold 46 (shown in FIGS. 2 and 3), which is connected to the valve 44 by a first supply fuel pipe 47 and coupled with the burner assembly 40 by a second fuel supply pipe 49. When an appropriate means for ignition (not shown) is provided and activated in the presence of fuel at the burner assembly 40, the burner assembly 40 produces a flame 48 (shown in FIGS. 2 and 3). The fuel is preferably combined with air, both inside and exterior to the burner assembly 40, to produce the flame 48.

The controller 66 (shown in FIG. 1) is provided for controlling one or both of 1.) the rate of fuel supply through the valve 44 to the burner assembly 40, and 2.) the rate of the induction fan 36 in response to the measured humidity in the target location 64. The purpose of the controller 66 is to ensure that the proper amount of steam is being supplied to the desired location through the duct 26 so that the proper humidity level will be reached. Increasing the fuel supply to the burner assembly 40 will generate more steam, resulting in a higher amount of steam being supplied to the desired location through the duct 26. Increasing the speed of the induction fan 36 will result in greater heat transfer from the combustion gases in the heat exchanger tube 28 to the water 18 in the tank 12, thereby resulting in a higher amount of steam being supplied to the desired location through the duct 26.

When a two-speed fan is employed, the air humidification process is preferably controlled by operating the induction fan 36 at a first speed and supplying the fuel within the range of supply rates in response to a high demand for humidity as determined by the measurement of humidity in the target location 64. The first speed is thus employed when the air at the target location 64 is more dry, i.e. when the demand for humidity is high. The induction fan 36 can also be operated at a second, lower speed, and the fuel can be supplied within the same or a different range of supply rates in response to a low demand for steam as determined by the measurement of humidity in the target location 64 (shown in FIG. 1).

Figure 1:
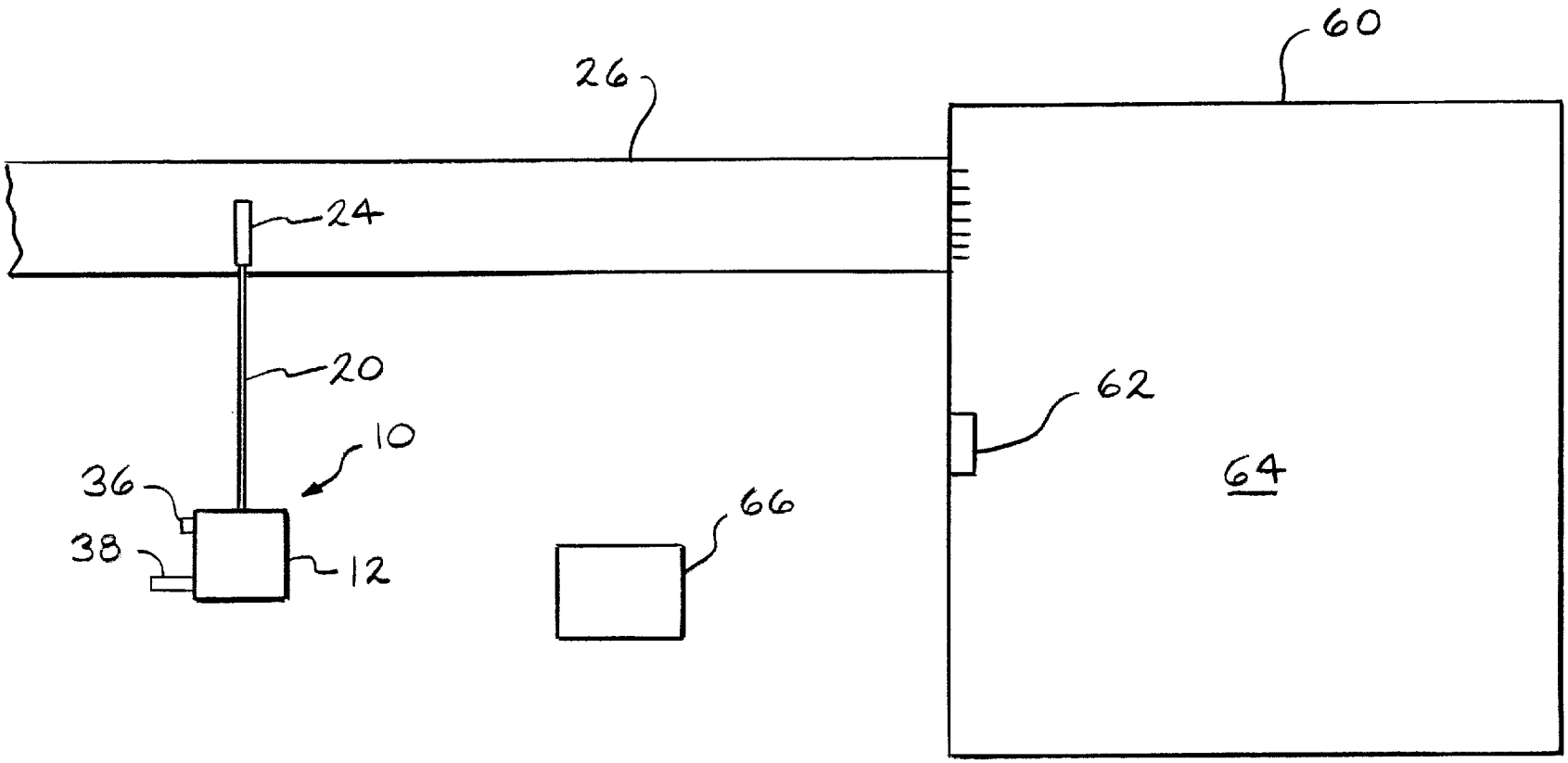
FIG. 1 is an elevational view in cross-section illustrating a gas fired humidifier according to the invention, shown in conjunction with a room to be humidified.

FIG. 1 illustrates the gas fired humidifier 10 providing steam to a desired location, such as a room 60 in a building (not shown). It should be understood that the steam need not be provided to a building. The room 60 includes a humidity measuring device, such as the humidity 62, adjacent to the target location 64. The desired location where steam is provided, such as the room 60, is preferably in fluid communication with the target location 64. In a preferred embodiment, the desired location and the target location 64 may be, for example, adjoining rooms (not shown) with a doorway provided therebetween.

The duct 26 directs steam to the room 60. The humidity 62 and the target location 64 need not be located at any particular location in the room 60 with respect to the duct 26. Fuel is provided through the fuel supply train 38 to heat the water 18 (shown in FIG. 2) in the tank 12. The induction fan 36 draws combustion gases through the heat exchanger tube 28. The steam outlet 20 provides steam 22 to the steam distributor 24 provided in the duct 26. The controller 66 is provided to control the amount of steam being delivered to the room 60. The controller 66 can include any suitable computer or similar device associated with one or more monitors or detectors.

The gas fired humidifier 10 may be operated as a sealed combustion system (not shown). The sealed combustion system may employ a shell (not shown) to encase all or parts of the gas fired humidifier 10. The shell may be provided to shield heat-sensitive objects, such as oxygen containers and solvent containers, from the flame 48. When the shell is employed, an air supply pipe (not shown) may be used to permit air to enter the shell and mix with the fuel being supplied to the burner assembly 40 of the gas fired humidifier 10.

Optionally, a temperature sensing device 58 (shown in FIGS. 2 and 3) preferably may be provided near the burner assembly 40 of the gas fired humidifier 10. For example, the temperature sensing device 58 may be mounted on a structure (not shown) adjacent to the supply manifold 46 of the fuel supply train 38. The temperature sensing device 58 may be provided as a safety feature to sense overheating, from a variety of causes, near the burner assembly 40. For example, it will be appreciated that if the induction fan 36 of the gas fired humidifier 10 should fail, or the heat exchanger tube 28 become clogged or congested, the structures near the burner assembly 40 could increase in temperature or overheat to the point of unsafe operating conditions. In the event of such an increase in temperature, the temperature sensing device 58 would sense the temperature and cause a signal to be sent. The signal would preferably eliminate the fuel supply being delivered to the valve 44, thus eliminating the supply of heat from the burner assembly 40.

The principle and mode of operation of this invention have been described in its preferred embodiments. However, it should be noted that this invention may be practiced otherwise than as specifically illustrated and described without departing from its scope.

What is claimed is:

1. A system for providing humidified air comprising:

a tank containing water;

one or more heat exchanger tubes mounted in the tank;

a burner assembly positioned to supply heat to the heat exchanger tubes;

an induction fan for inducing combustion gases from the burner assembly through the heat exchanger tubes whereby heat from the burner assembly in the heat exchanger tubes generates steam in the tank, the fan structured and configured to operate at a first speed wherein fuel is supplied to the burner within a range of supply rates, the fan further structured and configured to operate at a second speed wherein fuel is supplied to the burner within a different range of supply rates;

a steam dispersion apparatus connected to the tank for humidifying air with the steam;

a means for measuring humidity in a target location; and a controller for controlling one or both of the induction fin and the fuel supply to the burner assembly in response to the measured humidity in the target location.

2. The system of claim 1 wherein the induction fan is a two-speed fan and the controller is configured to control the two-speed induction fan.

3. The system of claim 1 wherein the induction fan is a variable-speed fan and the controller is configured to control the variable-speed induction fan.

4. The system of claim 1 wherein the one or more heat exchanger tubes comprises a plurality of heat exchanger tubes in the tank, and the burner assembly includes a plurality of burners with each burner being associated with a heat exchanger tube, and wherein the fan is configured for inducing combustion gases through the plurality of heat exchanger tubes.

5. The system of claim 1 further including a fuel supply train for delivering fuel to the burner, the fuel supply train including a valve for modulating the flow of fuel into the burner assembly, wherein the controller and the valve are configured to modulate the supply of fuel within a turn-down ratio of at least about 1.5 to 1.

6. The system of claim 1 wherein the heat exchanger tubes are serpentine in shape.

7. The system of claim 1 wherein the controller is configured to control the fuel supply to the burner assembly over a range of fuel supply rates.

8. The system of claim 1 wherein the tank is a hollow six-sided geometric shape.

9. The system of claim 1 wherein a fuel is supplied to the burner assembly by a fuel supply train.

10. The system of claim 1 wherein the tank is a hollow cylindrical shape.

11. A system for providing humidified air in a building comprising:

a tank containing water;

one or more heat exchanger tubes mounted in the tank;

a burner assembly positioned to supply heat to the heat exchanger tubes;

an induction fan for inducing combustion gases from the burner assembly through the heat exchanger tubes whereby heat from the burner assembly in the heat exchanger tubes generates steam in the tank, the fan structured and configured to operate at a first speed wherein fuel is supplied to the burner within a range of supply rates, the fan further structured and configured to operate at a second speed wherein fuel is supplied to the burner within a different range of supply rates;

a steam dispersion apparatus connected to the tank for humidifying building air with the steam;

a means for measuring humidity in a target location in the building; and a controller for controlling one or both of the induction fan and the fuel supply to the burner assembly in response to the measured humidity in the target location.

12. The system of claim 11 wherein the controller is configured to control the fuel supply to the burner assembly over a range of fuel supply rates.

13. The system of claim 11 wherein the induction fan is a two-speed fan and the controller is configured to control the two-speed induction fan.

14. The system of claim 11 wherein the induction fan is a variable-speed fan and the controller is configured to control the variable-speed induction fan.

15. The system of claim 11 wherein the one or more heat exchanger tubes includes a plurality of heat exchanger tubes in the tank and the burner assembly includes a plurality of burners with each burner being associated with a heat exchanger tube, and wherein the fan is configured for inducing combustion gases into the plurality of heat exchanger tubes.

16. The system of claim 11 further including a fuel supply train for delivering fuel to the burner, the fuel supply train including a valve for modulating the flow of fuel into the burner assembly, wherein the controller and the valve are configured to modulate the supply of fuel within a turn-down ratio of at least about 1.5 to 1.

17. The system of claim 11 wherein the heat exchanger tubes are serpentine in shape.

18. The system of claim 11 wherein the tank is a hollow six-sided geometric shape.

19. The system of claim 11 wherein a fuel is supplied to the burner assembly by a fuel supply train.

20. The system of claim 11 wherein the tank is a hollow cylindrical shape.

21. A method for controlling an air humidification process in a building comprising:

measuring the amount of humidity in a target location;

providing a fan having at least two speeds;

providing fuel to one or more burner assemblies, and burning the fuel to generate combustion gases;

operating the fan at first speed wherein fuel is supplied to the burner within a range of supply rates, and operating the fan at second speed wherein fuel is supplied to the burner within a different range of supply rates;

drawing the combustion gases with an induction fan from the one or more burner assemblies through a plurality of heat exchanger tubes to generate steam wherein the heat exchanger tubes are mounted in a tank containing water;

humidifying building air with the steam using a steam dispersion apparatus; and controlling one or both of the induction fan and the fuel supply to the burner assembly in response to the measured humidity in the target location.

22. The method of claim 21 wherein the fan is a variable speed fan.

23. The method of claim 21 wherein the fan is a two-speed fan.

24. The method of claim 21 further comprising:

operating the burner at a first fuel rate in response to a high demand for humidity as determined by the measurement of humidity in the target location; and operating the burner at a second fuel rate in response to a low demand for humidity as determined by the measurement of humidity in the target location.

25. The method of claim 21 further comprising:

operating the fan at a first speed in response to a high demand for humidity as determined by the measurement of humidity in the target location; and operating the fan at a second, lower speed in response to a low demand for humidity as determined by the measurement of humidity in the target location.

26. The method of claim 21 wherein the rate of providing fuel is controlled in response to the demand for humidity as determined by the measurement of humidity in the target location.

27. The method of claim 21 wherein the rate of drawing the combustion gases with the induction fan is controlled in response to the demand for humidity as determined by the measurement of humidity in the target location.

28. A method for controlling an air humidification process comprising:

measuring the amount of humidity in a target location;

providing a fan having at least two speeds;

providing fuel to one or more burner assemblies, and burning the fuel to generate combustion gases;

operating the fan at first speed wherein fuel is supplied to the burner within a range of supply rates, and operating the fan at second speed wherein fuel is supplied to the burner within a different range of supply rates;

drawing the combustion gases with an induction fan from the one or more burner assemblies through a plurality of heat exchanger tubes to generate steam wherein the heat exchanger tubes are mounted in a tank containing water;

humidifying air with the steam using a steam dispersion apparatus; and controlling one or both of the induction fan and the fuel supply to the burner assembly in response to the measured humidity in the target location.

* * * * *